United States Patent [19]

Loevinger

[11] Patent Number: 5,058,511

[45] Date of Patent: Oct. 22, 1991

[54] HEATED TANK CAR WITH DISCHARGE VALVE AND PRESSURE EQUALIZER

[76] Inventor: Richard P. Loevinger, 216 Oak Ridge Rd., Brandon, S. Dak. 57005

[21] Appl. No.: 610,091

[22] Filed: Nov. 7, 1990

Related U.S. Application Data

[63] Continuation of Ser. No. 380,096, Jul. 14, 1989, abandoned.

[51] Int. Cl.[5] ..... B61D 5/00

[52] U.S. Cl. ..... 105/451; 105/358

[58] Field of Search ..... 105/451, 358, 360; 165/41, 170, 145

[56] References Cited

U.S. PATENT DOCUMENTS

| | | | |
|---|---|---|---|
| 3,228,466 | 1/1966 | Carleton | 105/451 |
| 3,685,458 | 8/1972 | Price et al. | 105/358 |
| 4,476,788 | 10/1984 | Loevinger | 105/451 |
| 4,480,370 | 11/1984 | Loevinger | 105/360 |
| 4,530,288 | 7/1985 | Loevinger | 105/358 |
| 4,603,733 | 8/1986 | Loevinger | 105/358 |
| 4,624,189 | 11/1986 | Loevinger | 105/451 |

*Primary Examiner*—Robert J. Oberleitner
*Assistant Examiner*—Mark T. Le
*Attorney, Agent, or Firm*—Myers & Associates, Ltd.

[57] ABSTRACT

A railway tank car heated by steam through a heat exchanger located at the bottom of the tank car, the heat exchanger comprising pipes running lengthwise of the tank and outlets between the ends of the pipes. The outlet are arranged to drain hot condensate from different portions of the pipes into a cavity of a torus sleeved about a discharge valve in effective heat transfer thereto.

2 Claims, 5 Drawing Sheets

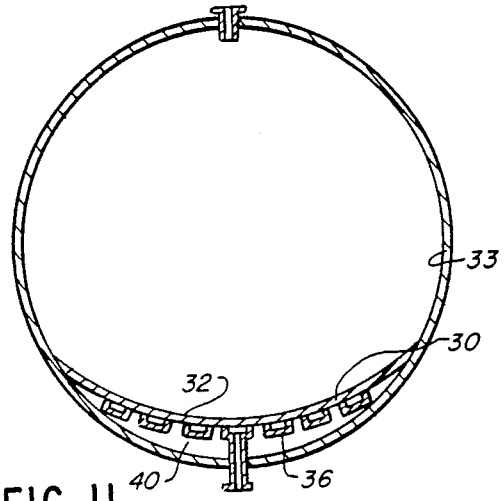
FIG. 11
FIG. 12
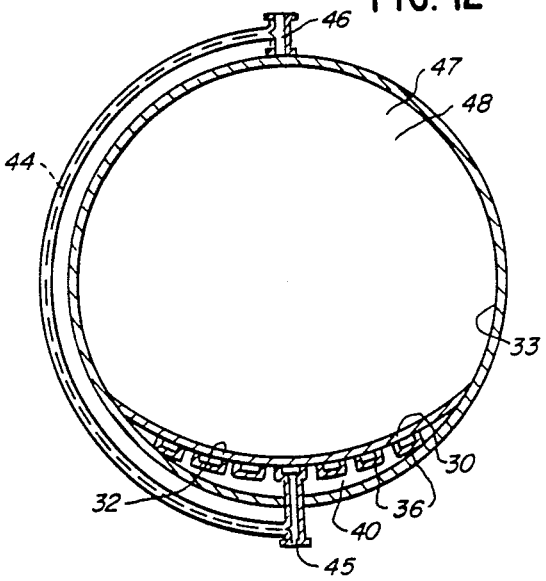
FIG. 13
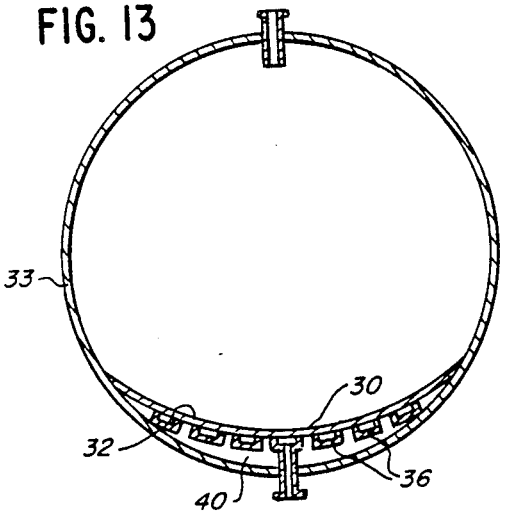
FIG. 14
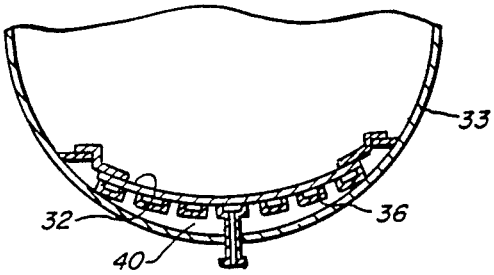

FIG. 17
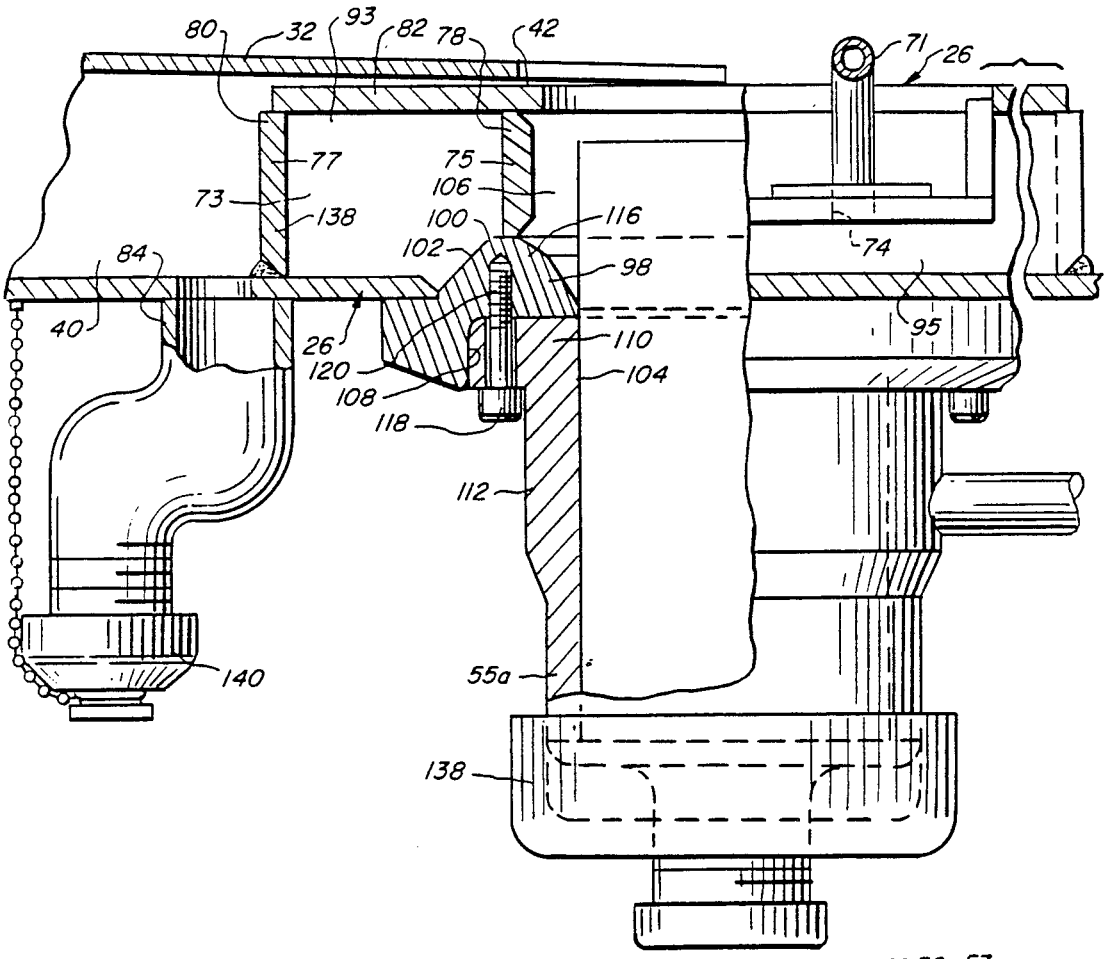
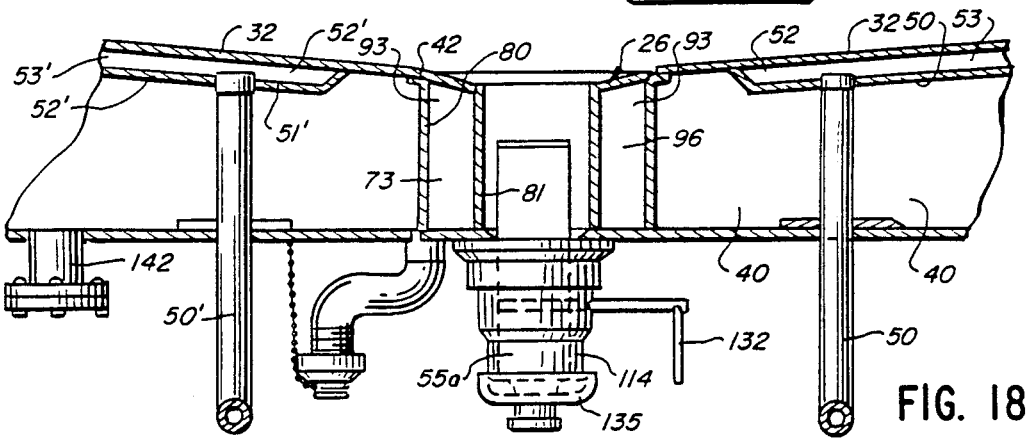
FIG. 18

HEATED TANK CAR WITH DISCHARGE VALVE AND PRESSURE EQUALIZER

This is a continuation of co-pending application Ser. No. 07/380,096 filed 7-14-89 now abandoned.

BACKGROUND OF THE INVENTION

This invention relates to heated railway cars and more specifically to a novel heat exchanger positioned within a cavity in the tank isolated from the product and in which the heating coils are arranged to discharge steam and condensate into a novel torus encircling the discharge valve in an improved heat-exchange relation therewith to maintain the product in liquid state and thus assure free flow of the product during extreme freezing weather conditions particularly such as experienced in the far North climes.

DISCUSSION OF THE PRIOR ART

The prior art is adequately discussed in my U.S. Pat. No. 4,663,733 issued Aug. 5, 1986 which is incorporated herein by reference, is a substantial improvement over the prior art and features a heater coil arrangement confined between a pair of complementary plates defining an envelope closed at opposite ends and supported by brackets at its lateral edges attached to the shell of the car. This patent also discloses a sump which surrounds the outlet in heat exchange relation thereto. It has been found that the arrangement of the sump and its quick discharge, although better than the prior art, fails at times to obtain adequate heat transfer to the product discharge valve obtain adequate heat transfer to the product discharge valve requiring the application of the hot steam externally of the shell in an attempt to unfreeze the valve. Depending upon weather conditions in the frozen north it Would take hours of heating and sometimes it required hammering on the valve to clear it of the frozen product and start the product flowing.

Furthermore the structure of the heat exchangers in the prior art and the construction of the opposing plates is in applicants prior patent embracing heating coils has been costly and added undesirable excess weight to the cars.

Furthermore it has been found the disposition of the heaters is important in order to properly heat the product and control of the heating medium as it passes through the heater coils. It is desirable to extract maximum BTU's from the heating medium until it heating capability is spent before it is discharged onto the ground.

Whereas the previous devices would dump condensate at about 200 degrees or much higher temperature, the improved structure retains the condensate in the torus, and preferably discharges it at about 140 degrees which, as is obvious, is much lower than previously thereby extracting more heat in the critical area namely in the region of the discharge nozzle to provide a favorable operating temperature.

The arrangement of the heating coils is such that at their discharge ends they are of reduced cross-section and provide a constriction to the outflow of condensate and thus retain the hot condensate in a dwell period sufficient to maximize extraction of the heat into the product without the introduction of complex controls which may be subject to breakdowns etc.

The instant arrangement has for its further object the provision of a pressure balancing arrangement between the top of the tank car above the level of the product and the housing encasing the heating coils.

These and other objects of the invention will become more readily apparent from the specification and the drawings wherein:

BRIEF DESCRIPTION OF THE DRAWINGS

FIGS. 11–14 are still further cross-sections through the car body;

FIG. 17 is a vertical cross-section taken on line 17—17 of FIG. 15, and FIG. 18 is a vertical cross-section through the torus and valve.

DESCRIPTION OF THE INVENTION

Figure 1:
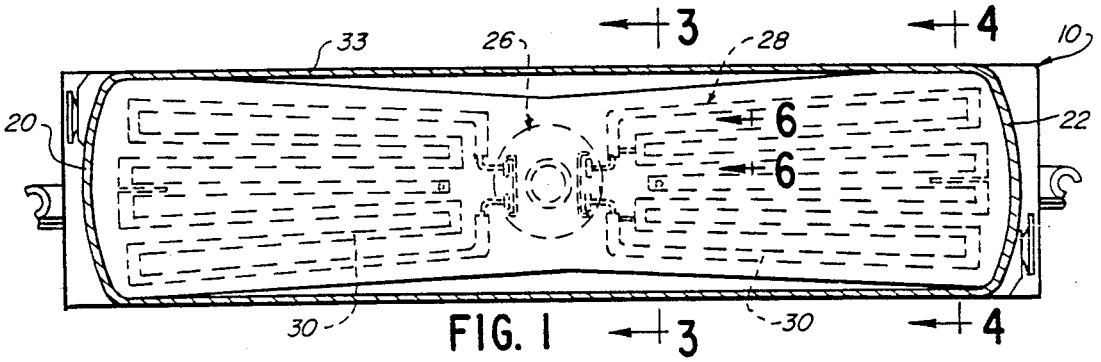
FIG. 1 is a top view of the invention shown partly in horizontal section.
Figure 2:
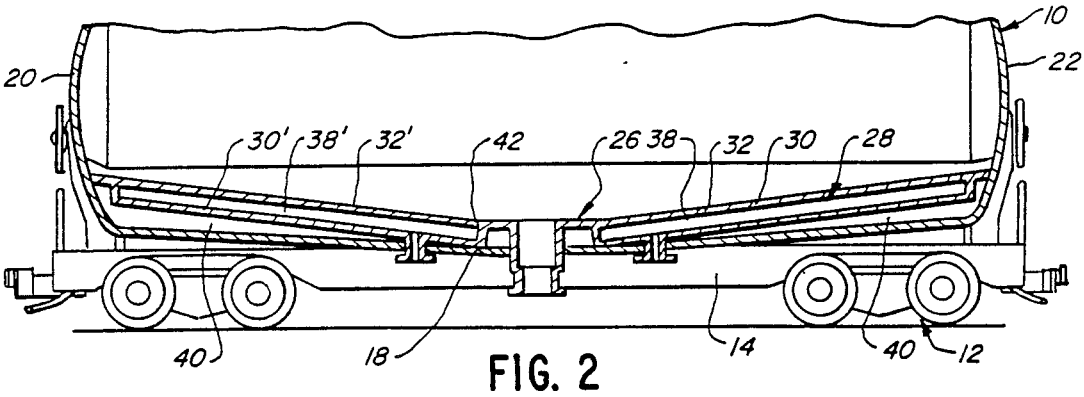
FIG. 2 is a vertical cross-section taken on line 2—2 of FIG. 1*b;*
Figure 3:
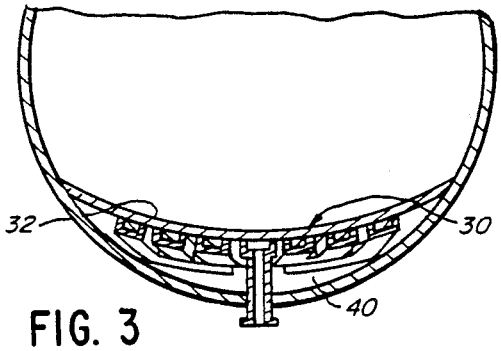
FIG. 3 is cross-section taken substantially on line 3—3 of FIG. 1.
Figure 4:
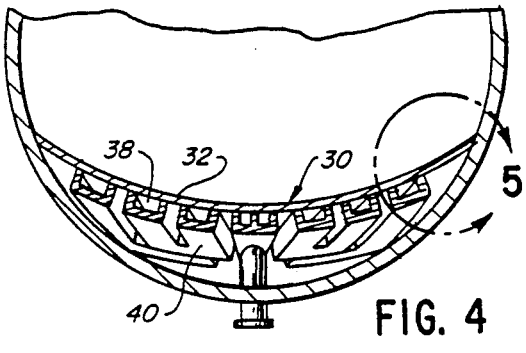
FIG. 4 is a cross-section taken on line 4—4 of FIG. 1.

The numeral 10 refers to a conventional railway tank car comprising a wheeled support 12 of conventional design. Storage container or tank 14 is mounted on the frame 12 by conventional structure such as by tank saddles 16. Tank 14 generally has a cylindrical configuration although the bottom 18 of the tank 14 slopes inwardly from the ends of tank heads 20 and 22 towards a discharge valve assembly generally designated 26. It is to this conventional tank car structure that the heat exchanger of this invention is mounted and which will be referred to generally by the reference numeral 28.

Heat exchanger 28 comprises heat exchanger units 30 and 30' which are identical except for being mirror images of each other. Inasmuch as units 30 and 30' are identical, only unit 30 will be described in detail with parts being indicated on unit 30 ' to indicate identical structure.

Figure 5:
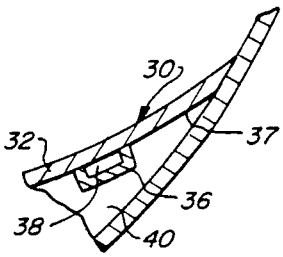
FIG. 5 is a enlarged cross-section of a portion of FIG. 4.
Figure 6:
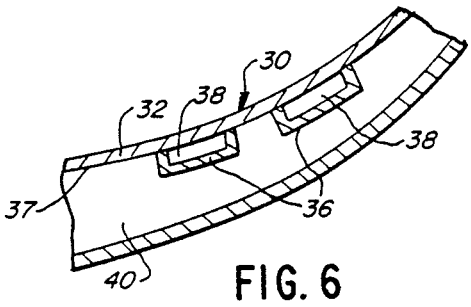
FIG. 6 is a further enlarged cross-section of a portion of structure of FIG. 7.
Figure 7:
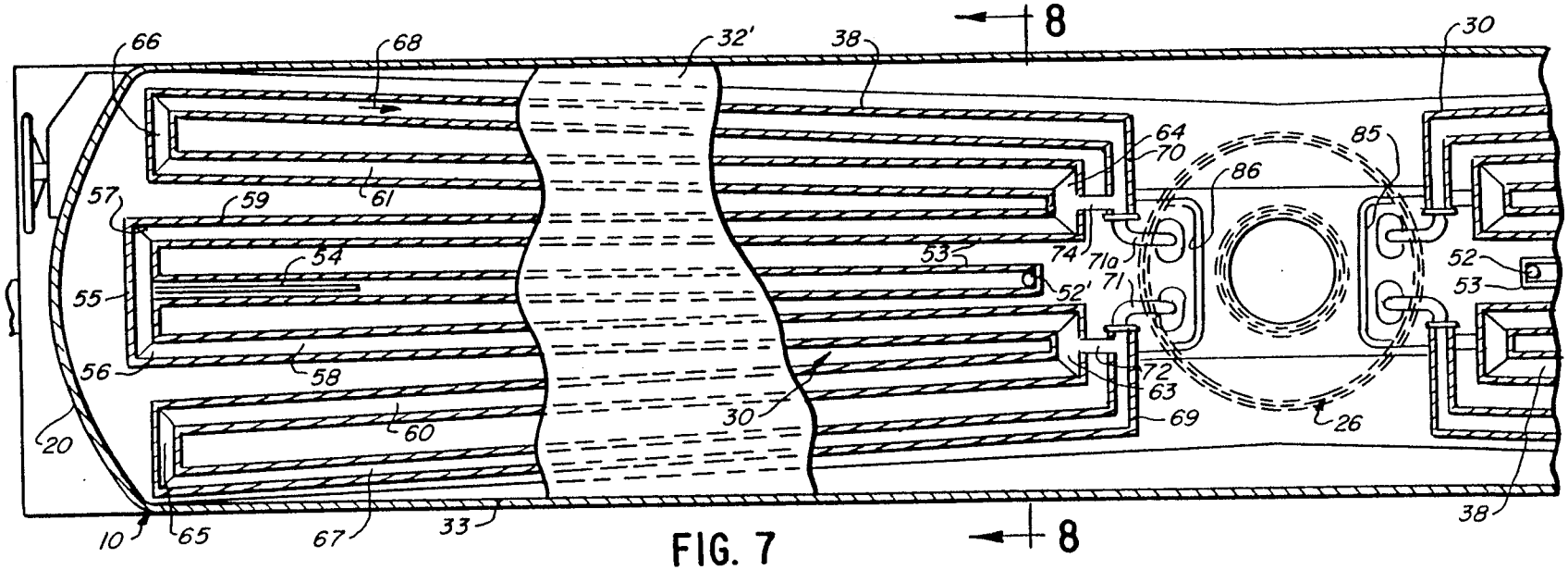
FIG. 7 is a top plain view with parts broken away and shown in section.
Figure 8:
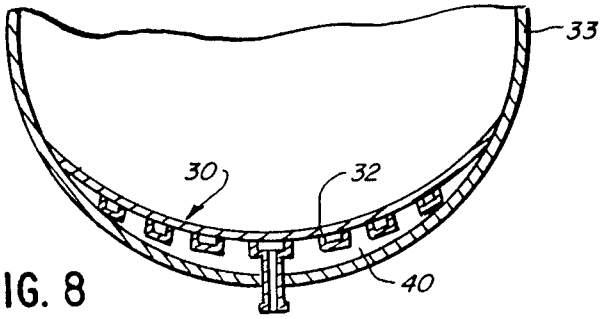
FIG. 8 is a cross-section of FIG. 7.
Figure 9:
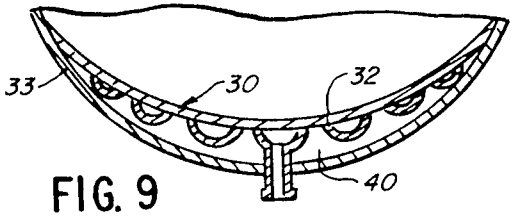
FIG. 9 is a further cross-section.
Figure 10:
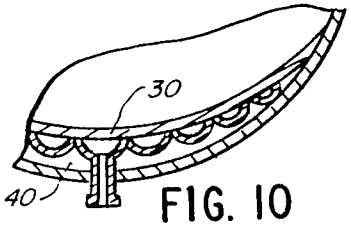
FIG. 10 is a still further cross-section.

Heat exchanger unit 30 comprises an arcuate or downwardly sloped top plate 32 having a plurality of U-shaped channels 36 secured, as by welding, at their open top sides to the underside 37 of (FIGS. 5 and 6) the plate 32 to form passageways or coils or tubes for steam and condensate. The plate or wall 32 defines with a torus wall portion 39 therebelow a thermal chamber 40 and is peripherally weld-connected to adjacent portions of the car tank body 33 and torus as at 42. The upper end of walls 32, 32' are welded to the tank heads 20, 22, respectively to provide the closed chambers 40.

A pressure equalizer tube or pipe 44 is connected at one end to the chamber 40 through a connector 45 in a wall 33 of the tank and at its upper end is preferably connected through a fitting 46 to the space 47 at the upper portion of the tank above the lading 48.

Referring now to the heat exchanger tubing 30, 30' there are provided inlet nozzles or pipes 50, 50' which depend from the bottom of the tank at opposite sides of the outlet valve and these coupling nozzles connect to the inlet pipes 51, 51' respectively. The inlet pipes 51 and 51' are connected to the lower ends 52, 52' of the respective center tubes or inlet coil members 53, 53'.

Each center tube 53 extends diagonally upwardly from the lading discharge nozzle 55*a* and has an upper end with a steam splitter 54 which connects to a transverse branch portion tube 55 intermediate its ends and the end portions thereof are connected to the upper ends 56, 57 of inner circulation tubes 58, 59 which slope downwardly and are respectively connected at their lower ends to transverse tubes 63, 64 to intermediate tubes 60, 61 which ascend from their lower portions to the respective ends of the car and are thereat connected at their upper ends by short tubes 65, 66 to outer end tubes 67, 68 which slope toward the center of the car. The lower ends of tubes 67, 68 which are connected to short transverse end tubes 69, 70 which are connected to outlet tubes 71, 71*a* of reduced cross-section with respect to the tubes to which they are connected to constrict the passage therethrough and reduce the flow of steam and condensate from the lower portions of tubes 60, 61 and 67, 68 which causes the steam and condensate to remain longer than usual in the heater tubes or coils so as to maximize the heat absorption into the product.

The disposition of the ends of the outlet tubes is of paramount importance in the provision of by-pass tubes 72, 74 which are connected between across tubes 63, 64 which extend between tubes 60, 67 and 61, 68 and the tubes 69, 70. Thus hot condensate is caused to flow into the outlet tubes from tubes 50, 61 into the outer tubes 71, 71*a*. In previous designs condensate and steam would be ported through the intermediate tubes 60, 61 and end or outboard tubes 67, 68. Thus the medium flowing through tubes 67, 68 is respectively cold (about 140 degrees ) by the time it reaches the outlet tubes. The outflow in the present design discharges the medium, which is at a substantially higher temperature than previously, preferably about 200 degrees F. In the present invention portions the outlet tubes 71, 71*a* are bent downwardly and extend into a recess 70*a* and are connected to a wall portion 72*a*, of an annular chamber 73 of a torus or annulus 26.

The discharge or outlet end portions are secured with intervening portions of a plate 76 to the lower end portion of the top plate 32. The plate 76 and the chamber plate and adjacent portion of the tank wall are welded leak proof and connected to provide an integral structure.

The same construction of the torus as well as the mounting of the discharge tube end portions prevail at the opposite side of the torus which has an outer ring 80 and an inner cylindrical sleeve 81 defining the intervening cavity or chamber 73 which is defined by top and bottom integral or welded to walls 32, 33.

A single outlet tube 84 is connected through a side opening at the lower end of the chamber 73 to discharge onto the ground.

It will be observed that the steam and condensate circulating through the tubes of the heat exchanger in the advance runs and the respective return runs are connected at their lower ends to by pass tubes 63, 64 which lead to the outlet tubes connected to the discharge or outlet tubes.

This feature insures that both condensate and steam invade all traversed through the entire length of tubing including the intermediate and outboard portions thereof.

The intermediate and outboard or end tubes are now primarily filled with hot steam which flows faster and easier therethrough than when pushing a head of condensate in these tubes as occurs in the prior art.

The bypass tubes serve as separators or filter devices for separating a large proportion of the condensate from the steam so that all of it does not have to be pushed through the entire length of the tubing.

This residual condensate is still hot preferably about 200 degrees F and is delivered through the outlet tubes into the top of a donut shaped housing or torus 26 into a chamber 73. Inasmuch as the outlet pipes and their position at the lower end of the coils and in that tubes 72, 74 are inclined towards the center of car, the coils drain gravitationally, and the condensate being heavier than the steam, separates from the steam. Thus the intermediate and end side tubes are in the present invention heated by the steam and a large quantity of condensate does not have to be pushed ahead of the steam in the last two conduits. Experiments have shown that the combination of what drains from the intermediate tubes into the outlet tubes combined with what drains from end tubes preferably at a much higher temperature than previously at about 200 degrees whereas in the old system the temperature of the medium discharging into the outlet tubes was at a much lower temperature than previously, somewhere about 140 degrees. It will be understood that the temperature hereby indicated would vary with the temperature of the ambient air and that these temperatures are used in a comparable sense.

The torus 26 or donut shaped vessel comprises an inner ring interconnected at their top edges 78, 80 by a plate 82 welded peripherally thereto. The inner edge of the plate 32 is welded to the top plate 82 and adjacent portions of the container wall or shell.

Figure 15:
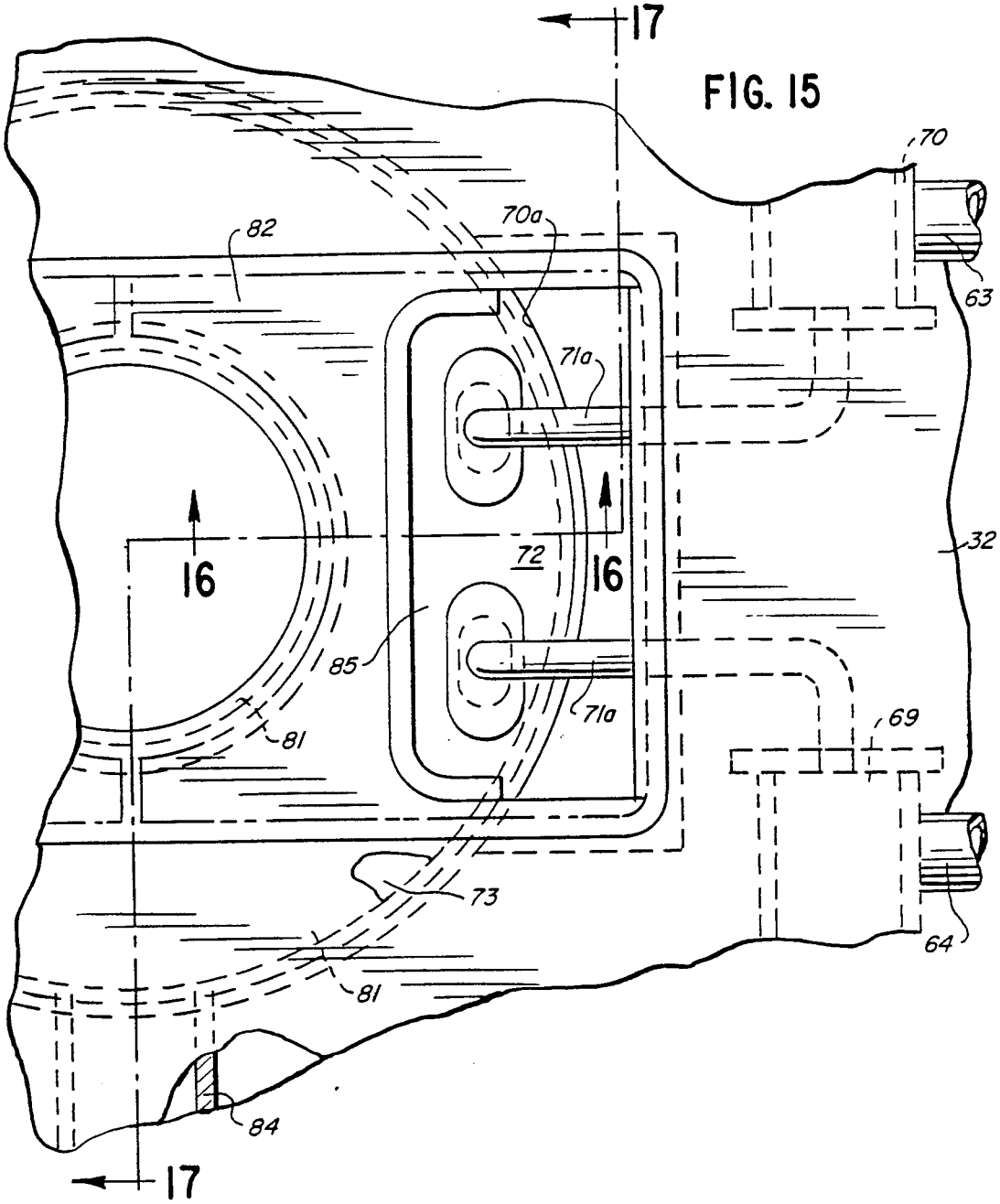
FIG. 15 is an enlarged fragmentary plan view of the torus and surrounding structure.
Figure 16:
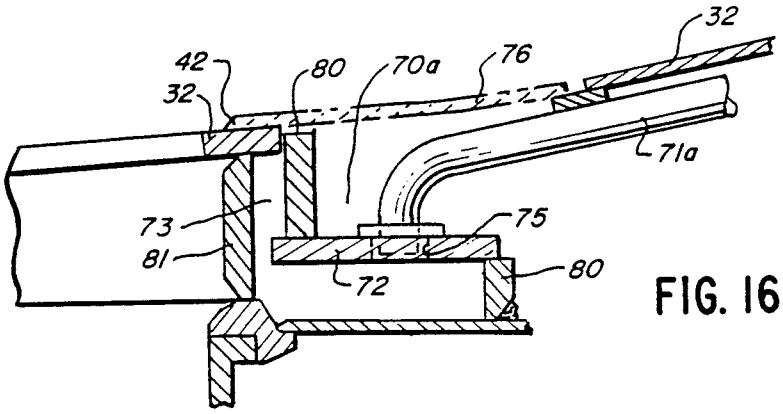
FIG. 16 is a fragmentary vertical section taken substantially on line 16—16 of FIG. 15.

The top wall or plate 82 is recessed at its opposite sides to form pockets 85, 86 and the outlet tubes are bent downwardly as best seen in FIGS. 15 and 16 and drain in each bottom pocket wall 72 within the confines thereof.

The purpose of recessing the top of the torus is two fold. One is to obtain a low level for the outlet tubes to gravitationally drain and tbe second is to introduce the condensate into a constricted area 95 (FIG. 17) to congest the condensate and fill the torus and maintain it filled and to obtain a greater dwell in the torus and the remaining chamber areas 96 and to maximize dissipation of heat from the condensate and to maintain laminar flow for efficient heat transfer to the encompassing parts.

The bottom of the chamber is closed off by the wall 40 of the shell of the tank.

The lower edges of the inner and outer rings 75, 77 are weld-connected to a ring 98 which is shaped to provide good thermal conductivity. It has a frusto-conical upper end portion 100 with a large area sloping side surface 102 facing into the chamber 73 for oblation by the hot condensate. Since the chamber portions 93 of chamber 73 are of enlarged cross-sectional areas, the hot condensate is minimally agitated and thus obtains a substantially laminar flow against surface 102 thus effecting maximum heat transfer to the ring 98 which has a center bore 104 in axial alignment with the center bore 106 of the torus, the bore 106 communicating at its upper end with the interior of the tank and providing an outlet for the product lading within the tank.

The bottom of the ring 98 has an annular recess 108 which admits a radial flange 110 of a tubular body portion 112 of a discharge valve 114 which is diagramatically shown. The make of the valve is unimportant as long as the body portion thereof is in intimate tight heat transfer contact with the thermal ring 98 which in the present instance has a thick body section 116. The flange of the valve is secured within the recess in the ring by bolts 118 which extend through apertures 120 and are threaded into the body section of the ring 98 and draw the flange against the bottom side of the ring and hold the radial edge in tight fit engagement with the annular edge of the bottom recess in the heat transfer ring. The valve is provided with an operating handle 132 (FIG. 18). The lower end of the valve housing or mounting is provided with a cap 135 threaded thereon and the discharge pipe 84 which is connected at its upper end through the tank shell to the discharge port 138 in the outer sleeve of the torus is also provided with a cap 140.

A capped inspection tube 142 is connected to the bottom of the tank and the steam inlet pipes 50, 50' are connected to the lower closed off ends of the inlet tubes of the heat exchangers. Pipes 50, 50' are provided with threaded connection, (not shown) (as is well known) for connection to the steam heater hose.

Experiments have shown that the construction herein disclosed is dramatically superior to the prior art structures in that not only is the product easily heated to readily discharge, but also the discharge valve is sufficiently heated so that it opens and closes practically effortlessly. The heating of the product from the bottom through the concave top plate of the heat exchanger obtains an extensive area of direct contact with the product and the application of the heat does not dissipate as in the prior art structures in unnecessarily heating parts which are not located in strategic areas to heat the product.

From the foregoing description it will be apparent that modifications can be made of the present invention without departing from the teachings of the invention. Also, it will be appreciated that the invention has a number of advantages, so of which have been specifically described and others are inherent in the invention. Accordingly the scope of the invention is only to be considered as set forth in the accompanying claims.

What is claimed is:

1. In a heated railway tank ar having a bottom, means providing closed chambers at opposite ends of the car along said bottom, heating coils in each chamber, each coil having interconnected center, intermediate and outer portions, a drain means at the bottom of the tank car, discharge means for discharging said coils comprising conduit means providing outlets separately connecting said intermediate portions and outer portions of said coils with the drain means, and passage means connecting said center portions to associated heating medium supply means.

2. A heater tank rail car comprising horizontally disposed lading container having opposite ends, top and bottom sides and a center portion, a discharge valve assembly disposed in the bottom of said center portion, heat exchanger means having continuous tube sections within the container extending from the center portion to opposite ends of the container for delivering hot condensate-producing heating medium therethrough, each tube section having an inlet at one end and a first outlet at its other end and having a second outlet intermediate its ends subdividing the associated tube section into first and second lengths having a juncture therebetween, said second outlet being disposed adjacent the center section of the container and in said juncture which contains excessive accumulation of condensate formed upon cooling of said heating medium in the first length of the associated tube section.

said first outlets formed to drain said excessive condensate to thereby facilitate the flow of the heating medium with reduced condensate through said second lengths of said tube sections;

and means for directing the condensate from the first and second outlets about the discharge valve assembly in heat exchange relationship therewith at a temperature sufficient to heat a lading to a pourable state.

* * * * *